US010107496B2

(12) United States Patent
Rathmann et al.

(10) Patent No.: US 10,107,496 B2
(45) Date of Patent: Oct. 23, 2018

(54) COMBUSTOR FRONT PANEL

(71) Applicant: ANSALDO ENERGIA SWITZERLAND AG, Baden (CH)

(72) Inventors: Ulrich Rathmann, Baden (CH); Naresh Aluri, Ennetturgi (CH); Kaspar Loeffel, Zürich (CH); Michael Huber, Baden (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 375 days.

(21) Appl. No.: 14/868,842

(22) Filed: Sep. 29, 2015

(65) Prior Publication Data

US 2016/0091206 A1 Mar. 31, 2016

(30) Foreign Application Priority Data

Sep. 30, 2014 (EP) ..... 14187141

(51) Int. Cl.
*F23R 3/00* (2006.01)
*F23R 3/06* (2006.01)
(Continued)

(52) U.S. Cl.
CPC ..... *F23R 3/002* (2013.01); *F23R 3/005* (2013.01); *F23R 3/007* (2013.01); *F23R 3/06* (2013.01);
(Continued)

(58) Field of Classification Search
CPC ..... F23R 3/002; F23R 3/005; F23R 3/007; F23R 3/06; F23R 3/10; F23R 3/283;
(Continued)

(56) References Cited

U.S. PATENT DOCUMENTS 5,941,076 A * 8/1999 Sandelis ..... F23R 3/002 60/752
6,298,667 B1 10/2001 Glynn et al.
(Continued)

FOREIGN PATENT DOCUMENTS

EP 0 724 119 A2 7/1996
EP 0 821 201 A1 1/1998
(Continued)

OTHER PUBLICATIONS

The extended European Search Report dated Feb. 22, 2016, by the European Patent Office in corresponding European Application No. 15186205.9. (7 pages).
Office Action (Communication pursuant to Article 94(3) EPC) dated May 31, 2017 by the European Patent Office in corresponding European Patent Application No. 15 186 205.9 (6 pgs).

*Primary Examiner* — Gerald L Sung
*Assistant Examiner* — Scott Walthour
(74) *Attorney, Agent, or Firm* — Buchanan Ingersoll & Rooney PC

(57) ABSTRACT

A front panel for a combustor has a hot side and a cold side and at least one reception adapted for receiving a combustor part. The front panel has a double-wall design with a hot-side wall and a cold-side wall. The hot-side wall defines a hot-side downstream surface of the front panel. The cold-side wall defines a cold-side upstream surface of the front panel. The hot-side wall and the cold-side wall are axially spaced from one another, extend parallel to one another, and are connected to one another by an outer side wall.

19 Claims, 2 Drawing Sheets

(51) Int. Cl.

| | |
|---|---|
| ***F23R 3/46*** | (2006.01) |
| ***F23R 3/42*** | (2006.01) |
| ***F23R 3/44*** | (2006.01) |
| ***F23R 3/50*** | (2006.01) |
| ***F23R 3/54*** | (2006.01) |
| ***F23R 3/10*** | (2006.01) |
| ***F23R 3/28*** | (2006.01) |
| ***F23R 3/60*** | (2006.01) |

(52) U.S. Cl.
CPC ..... *F23R 3/10* (2013.01); *F23R 3/283* (2013.01); *F23R 3/42* (2013.01); *F23R 3/44* (2013.01); *F23R 3/46* (2013.01); *F23R 3/50* (2013.01); *F23R 3/54* (2013.01); *F23R 3/60* (2013.01); *F23R 2900/00017* (2013.01); *F23R 2900/00018* (2013.01); *F23R 2900/03041* (2013.01); *F23R 2900/03342* (2013.01)

(58) Field of Classification Search
CPC ..... F23R 3/42–3/46; F23R 3/50–3/54; F23R 3/58; F23R 3/60; F23R 2900/00017; F23R 2900/00018; F23R 2900/03041; F23R 2900/03342
See application file for complete search history.

(56) References Cited

U.S. PATENT DOCUMENTS

| | | | | |
|---|---|---|---|---|
| 7,775,051 | B2 | 8/2010 | Hernandez et al. | |
| 9,057,523 | B2 | 6/2015 | Cunha et al. | |
| 2006/0059913 | A1* | 3/2006 | Bethke | F23R 3/002 60/725 |
| 2007/0199329 | A1 | 8/2007 | Hernandez et al. | |
| 2009/0188255 | A1* | 7/2009 | Green | F01D 9/023 60/737 |
| 2012/0060511 | A1 | 3/2012 | Zuo et al. | |
| 2013/0028288 | A1 | 1/2013 | Cunha et al. | |
| 2013/0042627 | A1 | 2/2013 | Gerendas et al. | |
| 2014/0020389 | A1 | 1/2014 | Melton et al. | |
| 2015/0184857 | A1 | 7/2015 | Cunha et al. | |

FOREIGN PATENT DOCUMENTS

| | | | |
|---|---|---|---|
| EP | 1 826 492 | A1 | 8/2007 |
| EP | 2 442 029 | A1 | 4/2012 |
| EP | 2 551 592 | A2 | 1/2013 |
| EP | 2 559 942 | A1 | 2/2013 |
| EP | 2 728 262 | A1 | 5/2014 |

* cited by examiner

COMBUSTOR FRONT PANEL

CROSS-REFERENCE TO RELATED APPLICATIONS

This application claims priority to European Patent Convention Application No. 14187141.8 filed Sep. 30, 2014, the contents of which is hereby incorporated in its entirety.

TECHNICAL FIELD

The present invention relates to gas turbine technology. More specifically, it refers to a front panel or end wall for a combustor, in particular for a silo, a can, or an annular combustor.

BACKGROUND

A combustor for a gas turbine is typically provided in a housing that surrounds the combustor. The combustor comprises a combustion zone or chamber. A combustible air-fuel mixture is burned in said chamber to produce hot combustion gases which flow along a fluid pathway to the turbine where they are expanded under production of kinetic energy. An end of said chamber in upstream direction relative to the fluid pathway is typically defined by a front panel that carries burner units, mixers or the like. The front panel is therefore a separation element that separates the cold side from the hot side of the combustor. Generally, the front panel is a thin plate that is supported, from the cold side, by a carrier structure that receives the front plate and further supports burner units, mixer, or igniter units. The stiff carrier structure is, accordingly, a rather massive construction on the cold side.

SUMMARY

It is an object of the present invention to provide a front panel for a combustor, in particular for a silo, a can, or an annular combustor, with an enhanced mechanical stability during operation.

This object is achieved by a front panel. Accordingly, the present invention provides a front panel for a combustor, in particular for a silo, a can, or an annular combustor, the front panel defining a hot side and a cold side and comprising at least one aperture (receptacle) adapted for receiving a combustor part. The front panel has a double-wall design with a hot-side wall and a cold-side wall, the hot-side wall defining a hot-side downstream surface of the front panel and the cold-side wall defining a cold-side upstream surface of the front panel, wherein the hot-side wall and the cold-side wall are axially spaced from one another, extend parallel to one another, and are connected to one another by an outer side wall.

A front panel typically delimits the upstream end of a combustion chamber of a gas turbine. The front panel typically comprises at least one opening through which a burner can feed fuel gas and an oxidizer gas, such as air.

The terms "upstream" and "downstream" refer to the relative location of components in a pathway or the working fluid. The term "axial" refers to the direction along the general flow direction of the working fluid; the terms "lateral" and "radial" refer to the direction perpendicular to the axial direction.

The term "combustor part" refers, e.g., to a mixer, a pre-mixer, an igniter, a burner unit, in particular a pilot burner.

The term "double-wall design" refers to an arrangement having two substantially parallel, axially spaced walls that are connected to one another. An axial spacing between the walls may range from 2.5 millimeters to 850 millimeters.

The term "silo combustor" refers to a combustion chamber with a substantially cylindrical shape, the chamber being connected to turbine via a transition duct. The silo combustor comprises at least one, preferably a plurality of, in particular 42 silo combustors that are arranged around a rotor axis of the turbine with an angular orientation to the rotor axis between 7° and 90°.

The front panel comprises a hot-side wall at a downstream end of the front panel. Axially spaced from the hot-side wall is arranged the cold-side wall, the latter providing an upstream end of the front panel. In some embodiments, the hot-side wall and the cold-side wall are preferably substantially flat plates that extend parallel to one another. In some embodiments, the hot-side wall and the cold-side wall are connected to one another by a radially outer side wall and by annular sleeves. The annular sleeves define passages through the front panel and may provide rim pieces for receiving combustor parts, i.e. they form apertures. Accordingly, the apertures allow for installation and removal of the combustor parts and the front panel provides rigid structural support to the combustor parts.

Accordingly, in some embodiments, the apertures are defined by the annular sleeves that extend from the hot-side wall to the cold-side wall and connect the same so as to provide a seat for the combustor parts. Moreover, the apertures provide a fluid passage through the front panel such that fluid(s) may be conveyed through the front panel and injected into a combustion zone downstream of the front panel.

In a particularly preferred embodiment, the double-wall structure comprising at least the hot-side wall and the outer side wall, preferably also the cold-side wall, is made from one piece, i.e. the double-wall structure is cast and/or machined from one piece. The annular sleeves may be fixed to the hot- and cold-side wall.

In some embodiments, one single aperture, in other embodiments a plurality of such apertures, preferably four circumferentially uniformly distributed apertures, may be provided. The apertures may be generally circular such as to allow a burner end tube to at least partially pass therethrough or therein. Generally, however, the apertures may have alternate shapes such as at least partly polygonal or round shapes such as to complement the shape of the element to be received. In particular embodiments, the apertures may be configured for receiving burners or mixers for injection of premixed fuel (air fuel mixer or premixed nozzles). The burner may be an Alstom EV or AEV burner.

The hot-side wall has a first material thickness and the cold-side wall has a second material thickness. In some embodiments the second material thickness is smaller than the first material thickness. The mechanical and thermal stress on the cold-side wall is smaller; therefore, material may be saved by making the cold-side wall thinner than the hot-side wall. Preferably, the first material thickness ranges from 1.5 millimeters to 28 millimeters, preferably from 4 millimeters to 15 millimeters, and is more preferably 6 millimeters. The second material thickness may preferably ranges from 20% of the first material thickness to 80% of the first material thickness.

A cavity is defined between the hot- and cold-side walls and the outer side wall. An axial height of the cavity may, in some embodiments, may range from 150% of the first material thickness to the difference between the total height of the front panel minus the sum of material thicknesses of the hot-side and cold-side walls. Accordingly, the axial height may range from 2.5 millimeters to 850 millimeters, depending on the specific geometry.

A spacing between the hot-side wall and the cold-side wall (i.e. an axial height of the cavity therebetween), a first and second material thickness, and a protrusion of the outer side wall over the downstream surface of the cold-side wall, if any, are chosen so as to have a total axial height of the front panel of 8 millimeters to 840 millimeters.

The cooling passages extend substantially axially through the cold-side wall of the front panel, from the cold-side wall's upstream surface to its downstream surface, so as to provide fluid communication through the cold-side wall from the cold side into the cavity between the cold-side wall and the hot-side wall. The cooling passages allow for better controlling a flow of the working fluid through the front panel as regards cooling and frequency control, which, ultimately, enhances the efficiency of the combustor.

In some embodiments, the hot-side wall may comprise a plurality of effusion passages, said passages extending substantially axially through the hot-side wall so as to provide fluid communication through the hot-side wall from the cavity into the combustion chamber. The effusion passages are through holes and allow film cooling to the hot-side surfaces in the combustion chamber.

In some embodiments, the cold-side wall may be perforated with a plurality of through holes and cut-outs to control cooling air access to the hot-side wall and to control frequency tuning of the natural frequencies of the front panel, which need to be tuned above a certain limit. Accordingly, the cold-side wall may act as a stiffener plate and helps to optimize the mechanical, the fluid-dynamical, and the thermal properties of the front panel.

In some embodiments, the outer side wall may circumferentially surround the hot-side wall and the cold-side wall and may be a substantially axially extending wall.

In some embodiments, an upstream periphery edge, i.e. on the cold side of the front panel, of the outer side wall may be provided a clamping ring. The clamping ring is oriented laterally inwardly or outwardly. Preferably, the clamping ring has a lateral annular radius and an axial height, wherein the lateral annular radius ranges from 2 millimeters to 25 millimeters and the axial height ranges from 2 millimeters to 25 millimeters. By means of this clamping ring the front panel may be secured to another part of a combustor arrangement.

In some embodiments, a downstream periphery edge, i.e. on the hot side of the front panel or opposite of the upstream periphery edge of the outer side wall may be rounded.

Preferably, the outer side wall is flush with the hot-side downstream surface. In addition or in the alternative, the outer side wall protrudes or projects over the downstream surface of the cold-side wall.

Accordingly, in some embodiments, the radially outward portion of the front panel has, in cross-sectional view, a swan neck profile with a free end that extends substantially in the lateral (with respect to the flow direction) or radial (with respect to the front panel) direction to form the clamping ring.

Moreover, the outer side wall may have, in some preferred embodiments, at least one structured intermediate section. Accordingly, the outer side wall may have at least one first intermediate portion that has a material thickness that is smaller than a material thickness of a second portion of the outer side wall. In addition or in the alternative, the front panel may have at least one first intermediate portion of the outer side wall that is laterally shifted with respect to a second portion of the outer side wall to provide the outer side wall with a structure. Accordingly, the outer side wall may have, in cross-section view, a kink and/or an undulation and/or a step or the like, which makes it non-planar. The non-planar structure may additionally or alternatively be achieved by adding recesses, i.e. by varying the material thickness of the structured intermediate portion of the outer side wall. Also, the intermediate section may additionally or alternatively be undulated.

In preferred embodiments, the material thickness of the first intermediate portion of the outer side wall is 50% to 80% of the material thickness of the second portion of the outer side wall.

A lateral shift the first intermediate portion of the outer side wall with respect to the second portion of the outer side wall is, preferably, 30% to 100% of a material thickness of the second portion.

A structured outer side wall, as described above, has benefits over flat or planar outer side walls, as the latter endure significant loads from thermal gradients and pressure fluctuations without having the benefit of mechanical stiffness created by the shape like cylinders or cones.

Generally, any or all the elements of the front panel, in particular the downstream surface of the hot-side wall, the latter being exposed to the flame side, may be coated with a heat resistant layer such as a thermal barrier coating in order to improve heat resistance of the front panel.

The front panel may be clamped at its periphery edge to a carrier structure of a combustor arrangement for a gas turbine using bolts, hooks or the like. Alternatively, the front panel may be clamped to the combustor part, in particular to a central pilot burner or one or more mixer pieces. Accordingly, the present invention also relates to combustor arrangements for gas turbines with a front panel as described above.

The front panel bridges the lateral gap between the combustor part and an outer rim of the combustor arrangement. Moreover, the front panel may be clamped to a central pilot burner or to one or more mixer pieces (in this case the central pilot burner has to be fixed to the front panel).

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DETAILED DESCRIPTION

Figure 1:
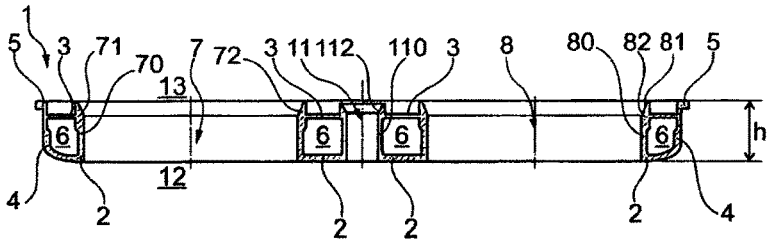
FIG. 1 shows a cross-section view of a front panel according to a first embodiment of the present invention.

FIG. 1 shows a cross-section view of a front panel 1 according to a first embodiment of the present invention.

Figure 2:
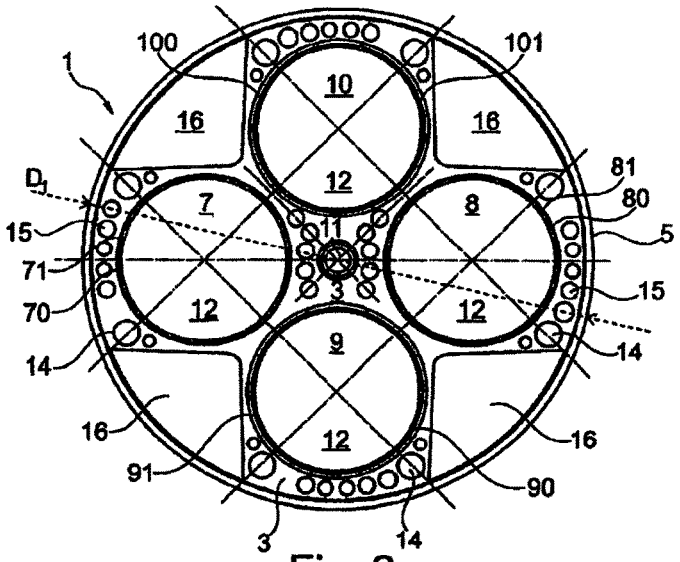
FIG. 2 shows a top-view of the front panel according to FIG. 1.

The cross-section is along a diameter D1 of the generally circularly shaped, plate-like front panel 1. FIG. 2 shows the front panel 1 according to FIG. 1 in a top view from the cold side 13. The first embodiment according to FIGS. 1, 2 is now described in detail.

The front panel 1 defines a hot side 12 and the cold side 13. The front panel 1 has a double-wall design and comprises a hot-side wall 2 (first wall) and a cold-side wall 3 (second wall). The hot-side wall 2 has an upstream surface 21 and a downstream surface 22 (see FIG. 3). The cold-side wall 3 has an upstream surface 31 and a downstream surface 32 (see FIG. 4). The upstream surface 21 of the hot-side wall 2 faces the cold-side wall 3; the downstream surface 22 of the hot-side wall 2 is on the hot side 12 of the front panel 1. The upstream surface 31 of the cold-side wall 3 is on the cold side 13 of the front panel 1; the downstream surface 32 of the cold-side wall 3 faces the hot-side wall 2. On the cold side 13, fluids are supplied to the front panel 1, e.g. oxidizer and fuel mixing and supplying may be done. The fluids are then guided through the front panel 1, from the cold side 13 to the hot side 12, i.e. to the flame side, where the fuel mixture is burned in a combustion zone, the latter being defined downstream of the hot-side wall 2. From the combustion zone the compressed hot working fluid is guided to the turbine and expanded under production of kinetic energy.

The hot-side wall 2 and the cold-side wall 3 are substantially circular walls and define the lateral diameter D1 of the substantially circular front panel 1. The walls 2, 3 are arranged at an axial distance to one another, i.e. spaced relative to one another to create the double-wall structure. The walls 2, 3 extend generally parallel to one another, while having substantially the same lateral dimensions, in particular the same diameter D1. The cold-side wall 3 preferably has a smaller material thickness than the hot-side wall 2. In particular embodiments, the walls 2, 3 may have any shape.

The hot-side wall 2 and the cold-side wall 3 are connected to one another by a radially outer side wall 4. The outer side wall 4 extends generally axially and circumferentially around both the hot-side wall 2 and the cold-side wall 3.

The front panel 1 comprises a plurality of apertures 7 to 10, each for receiving a combustor part such as a burner, mixer, or igniter element. In some embodiments, there is provided one, two, three, five, six, or more apertures 7 to 10. In the embodiment according to FIGS. 1 and 2, four apertures 7 to 10 are provided in the front panel 1. Each aperture 7 to 10 is provided in a quarter sector of the front panel 1 and includes a rim element for seating and sealing the particular combustor part. Furthermore, each aperture 7 to 10 comprises a passage for conveying fluids provided on the cold side 13 through the combustor part from the cold side 13 to the hot side 12 of the front panel 1.

Side walls of the apertures 7 to 10 are provided by annular sleeves 70, 80, 90, 100, the latter extending generally axially through the front panel 1, from the cold side 13 to the hot side 12. The annular sleeves 70, 80, 90, 100 are fixed to openings in both the hot- and cold-side wall 2, 3, thereby connecting the latter to one another and further supporting the double-wall structure. The annular sleeves 70, 80, 90, 100 limit the apertures 7, 8, 9, 10 in radial and axial directions. The annular sleeves 70, 80, 90, 100 have a generally right circular cylinder shape. They provide a passage for combustor parts such as burner units or the like for introduction of fluids in to the combustion chamber on the hot side 12. In FIG. 2, one can see, from the cold side 13 to the hot side 12, through the passages of apertures 7 to 10. The annular sleeves 70, 80, 90, 100 connect the hot-side wall 2 and the cold-side wall 3 to one another and therefore enhance the mechanical stability of the front panel 1. At an upstream periphery edge of each the sleeves 70, 80, 90, 100 is provided a tapered portion 71, 81, 91, 101 that protrudes substantially perpendicularly over the upstream surface 31 of the cold-side wall 3. The tapered protrusions 71, 81, 91, 101 have each a slanted surface, the latter facing the respective apertures 7 to 10, and a substantially axially oriented surface opposite of the slanted surface. The tapered protrusions 71, 81, 91, 101 run circumferentially around the respective aperture 7, 8, 9, or 10. The slanted periphery edge of portions 71, 81, 91, 101 serve for easy insertion (e.g. optimized guidance) and optimal seating of the received combustor part (not shown). In addition a height of the respective aperture 7, 8, 9, or 10 can have a variation to ease the assembly, for example a variation in height of between 3 and 10 mm, or preferably around 6 mm.

Additionally, in some embodiments, the upstream section of the annular sleeves 70, 80, 90, 100, 110 may be reinforced or have an enhanced material thickness. Accordingly, the annular sleeves 70, 80, 90, 100 of the apertures 7 to 10 may have their upstream section (upper third to upper forth of the entire axial extension) provided as a reinforced section 72, 82, 92, 102 with a material thickness that is 50% to 150%, preferably about 100%, thicker than a material thickness of the downstream section of the sleeves 70, 80, 90, 100. A transition section from the downstream section to the thicker upstream section 72, 82, 92, 102 of the sleeve 70, 80, 90, 100 may be a flat ramp or a rounded transition section.

In front panel 1, a further central passage 11 may be arranged (see below). The further passage 11 may also have an annular sleeve 110 with a reinforced upstream section 112. Said reinforced upstream section 112 may be arranged in a region where the cold-side wall 3 laterally joins the sleeve 110 (see FIG. 1).

Typical diameters of the apertures 7, 8, 9, 10 range from 50 millimeters to 1000 millimeters depending on the designated combustor part and the number of units to be received by the front panel 1.

A cavity 6 is defined between the hot-side wall 2, the cold-side wall 3, the outer side wall 4, and the annular sleeves 70, 80, 90, 100, 110. This cavity 6 has an axial height $h_p$, which corresponds to the axial distance between the upstream surface 21 of the hot-side wall 2 and the downstream surface 31 of the cold-side wall 3. The cavity 6 serves as an insulation volume. The distance $h_p$ between the walls 2, 3, or in other words the cavity 6, helps in enhancing a mechanical stability of the front panel 1, in particular by increasing an area momentum of inertia of the front panel 1 (in cross-sectional view according to FIGS. 1, 3 to 5).

The cold-side wall 3 acts as a stiffener plate that helps to mechanically stabilize the front panel 1 and, at the same time, to tune the natural frequencies of the front panel 1 such that its natural frequencies are preferably above a certain limit. The cold-side wall 3 extends parallel to the hot-side wall 2 and connects the outer side wall 4 with the mixer-rim pieces, i.e. with the annular sleeves 70, 80, 90, 100, 110. Moreover, the cold-side wall 3 is perforated with holes 14, 15 and cut-outs 16 for conveying cooling air to the hot-side wall 2 (in particular for passage through the effusion holes 23, see FIG. 4) and for frequency tuning (see FIG. 2).

Accordingly, in the cold-side wall 3 are provided a plurality of fluid passages 14, 15. These fluid passages 14, 15, 16 are passages for a cooling fluid, e.g. air. Some of the cooling passages 14, 15 may have a generally circular shape. Some of the generally circular cooling passages 14, 15, i.e. the small cooling passages 15, have a small diameter (e.g. 5 millimeters to 15 millimeters), while others, i.e. the medium cooling passages 14, have a larger diameter (e.g. 10 millimeters to 30 millimeters). Yet other cooling passages 16 may have a different shape than generally circular and may be quite larger. The large cooling passages 16 with different shape may be cut-outs that dominate the frequency tuning property of the front panel 1. In the embodiment according to FIG. 2, the cut-outs 16 have a substantially triangular shape, while the hypotenuse-like section of the triangle is a circular sector of the outer edge of the circular cold-side wall 3. It is to be understood that the number, shape, and arrangement of the cooling passages 14, 15, 16 in cold-side wall 3 may be of any shape or size, depending on the actual combustor requirements.

The fluid passages 14, 15, 16 extend from the upstream surface 31 of the cold-side wall 3 to its downstream surface 32 and thereby fluidly connect the cold side 13 and the cavity 6 to one another. Accordingly, the cooling passages 14, 15, 16 provide the cooling fluid to effusion passages 23, the latter being provided in the hot-side wall 2 (see FIG. 4).

Moreover, in a center of the front panel 1, a further central passage 11 is provided. As can be seen in FIG. 1, unlike the cooling passages 14 to 16 that only extend into cavity 6, the further passage 11 (like the passages of the apertures 70, 80, 90, 100) extends from the cold side 13 to the hot side 12. The passage 11 is therefore a through-hole through the front panel 1. It is defined by a central hole in both walls 2, 3 which are connected by the further annular sleeve 110, which connects the center part of the cold-side wall 3 and the hot-side wall 2. A diameter of the further passage may be the same as the diameter of the medium cooling passage 15. An upstream end of the annular sleeve 110 may be slanted like the other annular sleeves 70, 80, 90, 100, the slanted surface facing the center of the front panel 1.

The hot-side wall 2 and the outer side wall 4, and preferably the cold-side wall 3, may be cast and/or machined from one piece. The annular sleeves 70, 80, 90, 100, 110 may be welded or attached to the walls 2-4.

Figure 3:
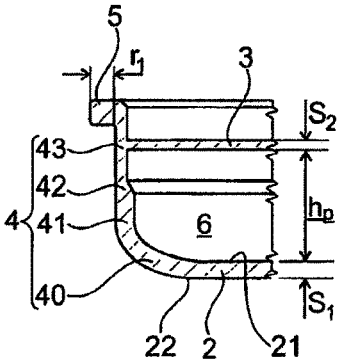
FIG. 3 shows an enlarged cross-section view of a radially outer side wall of the front panel according to FIG. 1.
Figure 4:
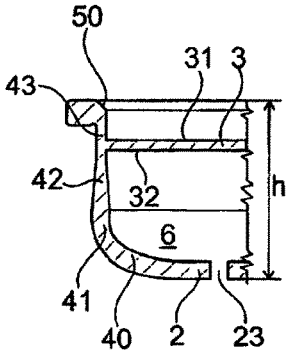
FIG. 4 shows an enlarged cross-section view of a second embodiment of the present invention with a differently structured radially outer side wall.
Figure 5:
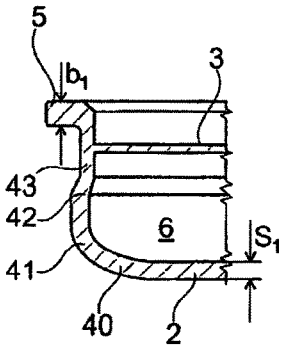
FIG. 5 shows an enlarged cross-section view of a third embodiment of the present invention with a yet a further differently structured radially outer side wall.
Figure 6:
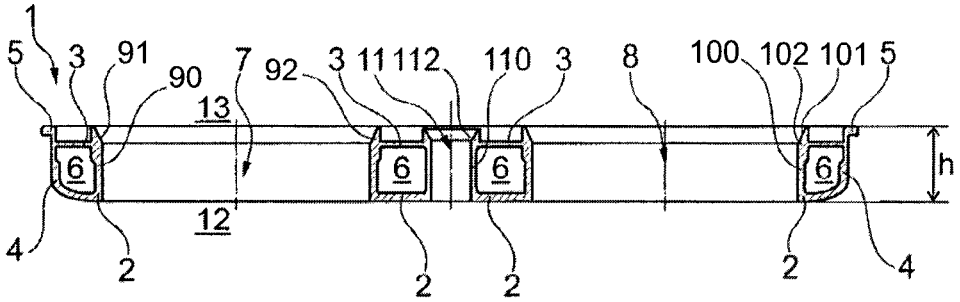
FIG. 6 shows a cross-section view of a front panel according to a first embodiment of the present invention.

FIGS. 3 to 5 show preferred embodiments of the front panel 1 according to invention. In particular, FIGS. 3 to 5 show, in a cross-sectional view, differently structured outer side walls 4.

A total height h of the front panel 1 may be 4% to 40% of a diameter D1 of the circular front panel 1.

The diameter D1 of the front panel 1 may be 198 millimeters to 2100 millimeters.

A thickness $S_1$ of the hot-side wall 2 may be 1/75 to 1/125 of D1. The thickness of $S_1$ depends on the cooling requirement. It can be designed for effusion cooling, which typically requires a minimum $S_1$ ranging from 4 millimeters to 15 millimeters. Preferably, $S_1$ is about or exactly 6 millimeters thick.

A thickness $S_2$ of the cold-side wall 3 may typically be small compared to the thickness $S_1$ of the hot-side wall 2 for elasticity. Preferably, $S_2$ ranges from 20% of $S_1$ to 80% of $S_1$.

The outer side wall 4 has a downstream portion 41 and an upstream portion 43. The upstream portion 43 includes a free end with a radially outwardly protruding clamping ring 5. The clamping ring 5 is circumferentially surrounding the front panel 1 and serves for fastening of the front panel 1 in a combustor arrangement. The clamping ring 5 has a material thickness or height $b_1$ in axial direction (see FIG. 5). This axial height $b_1$ may be 2 millimeters to 25 millimeters. A radial width $r_1$ of the annulus of 5, i.e. the annular radius, may be 2 millimeters to 25 millimeters wide. A radially inner periphery edge 50 of the clamping ring 5 may be slanted (see FIG. 4). The clamping ring 5 is configured for being clamped by further combustor part. The clamping ring 5 may be clamped between a carrier structure and a combustion liner of a gas turbine. The clamping ring 5 according to FIGS. 1 to 5 is oriented radially outwardly. In other embodiments, the clamping ring 5 may be oriented radially inwardly.

Downstream of the downstream portion 41 of the outer side wall 4 joins a first transition portion 40 which connects the outer side wall 4 to the hot-side wall 2. The first transition portion 40 is rounded with an osculating circle having a radius of the material thickness of the hot-side plate 2. This radius may also be 10% to 300% or more of said material thickness. Along the first transition portion 40 the orientation of the outer side wall 4 of the front panel 1 changes its orientation from radial to axial. The first transition portion 40 therefore matches the hot-side wall 2 and the outer side wall 4 in orientation and thickness. The change in orientation is done within 10% to 20% of the total height h of the front panel 1 (see FIG. 4).

The outer side wall 4 may be structured such that the mechanical, fluid-mechanical, and thermal properties of the front panel 1 are improved. Therefore, a second transition portion 42 may be provided between the upstream and the downstream portion 41, 43. This second transition portion 42 connects the upstream and the downstream portion 41, 43. In some embodiments, the upstream portion 43 may have a thinner material thickness than the downstream portion 41, e.g. the upstream portion 43 may have a material thickness that is 50% to 90% of the material thickness of the downstream portion 41. The transition section 42 may be a ramp or a rounded section that connects the two differently dimensioned sections. The adjustment of the material thickness in the transition portion 42 may be done on the inside (facing the cavity 6, see FIG. 3) or it may be done on the outside, or it may be done on both sides (see FIG. 4). In some embodiments, the transition portion 42 may also or additionally be a kink (see FIG. 5). Here, the downstream portion 41 is shifted laterally with respect to the upstream portion 43; accordingly, the upstream and downstream portions 41, 43 are no longer axially aligned. Moreover, the outer side wall 4 may be undulating or of any other laterally displacing shape. In preferred embodiments, both the material thickness and a kink structure may be present in the outer side wall 4 (see FIG. 5). This structuring of the outer side wall 4 enhances the mechanical stability of the front panel 1.

The axial height $h_p$ of the cavity 6 ranges between $1.5S_1$ and $(h-(S_1+S_2))$. The axial height $h_p$ is constant over the front panel 1 and decreases in the radial outer part as the first transition section 40 guides the outer wall of the front panel 1 into axial direction.

FIG. 3 shows the embodiment according to FIGS. 1 and 2. The downstream portion 41 has the same material thickness as the hot-side wall 2, i.e. $S_1$. The second transition portion 42 tapers from the inside to match the material thickness of the upstream portion 43, the latter being about 50% of the material thickness of the downstream portion 41. The transition portion 42 is arranged in the upper half of the cavity 6 and has a height in axial direction of about $S_1$. A height of a portion of the cavity 6 associated with the upstream portion 43 is about half of a height of a portion of the cavity 6 associated with the downstream portion 41. The total height of the cavity 6 is $h_p$.

FIG. 4 shows an embodiment with a transition portion 42 that is tapering on both the inner and the outer surface of the outer side wall 4 so as to match the downstream portion 41 to the upstream portion 43. As can be seen, the transition portion in 42 extends over more than the upper half of the cavity 6 and continues axially upstream to the cold-side wall 3.

FIG. 5 shows a further embodiment where the transition portion 42 is arranged in the upper half of the cavity 6 and has a height in axial direction of about $S_1$, as the embodiment in FIG. 3. The downstream portion 41 has the same material thickness as the hot-side wall 2, i.e. $S_1$. The upstream portion 43 has a material thickness that is about 75% of $S_1$. The transition portion 42 is shaped to cause a shift of the upstream portion 43 relative to the downstream portion 41 into the cavity 6 by about 30% to 50% of $S_1$. Accordingly, the outer side wall 4 in the embodiment according to FIG. 5 has a kink.

The herein described embodiments of the invention are given by way of example and explanation and do not limit the invention. To someone skilled in the art it will be apparent that modifications and variations may be made to these embodiments without departing from the scope of the present invention. In particular, features described in the context of one embodiment may be used on other embodiments. The present invention therefore covers embodiments with such modifications and variations as come within the scope of the claims and also the corresponding equivalents.

The invention claimed is:

1. A front panel for a combustor of a gas turbine, the front panel defining a hot side and a cold side and comprising:

at least one aperture adapted for receiving a combustor part;

a hot-side wall defining a hot-side downstream surface of the front panel;

a cold-side wall defining a cold-side upstream surface of the front panel, wherein the hot-side wall and the cold-side wall are axially spaced from one another and extend parallel to one another; and an outer side wall connecting the hot-side wall and the cold-side wall, wherein each aperture of the at least one aperture is defined by a respective annular sleeve, wherein each respective annular sleeve extends from the hot-side wall to the cold-side wall, connects the hot-side wall and the cold-side wall to one another, and provides a seat for a respective combustor part, wherein an upstream portion of each respective annular sleeve has a material thickness that is 50% to 150% thicker than a material thickness of a downstream portion of the respective annular sleeve.

2. The front panel according to claim 1, wherein the hot-side wall and the outer side wall are made from one piece.

3. The front panel according to claim 1, wherein the hot-side wall is provided with a plurality of effusion passages, the effusion passages being through holes that extend substantially axially through the hot-side wall.

4. The front panel according to claim 1, wherein cooling passages are provided in the cold-side wall, the cooling passages being through holes that extend through the cold-side wall for controlling a fluid stream through the cold-side wall to the hot-side wall for cooling and frequency tuning purposes.

5. The front panel according to claim 1, wherein the outer side wall defines a circumference of the front panel.

6. The front panel according to claim 1, wherein a downstream end of the outer side wall is flush with the hot-side downstream surface.

7. The front panel according to claim 1, wherein a downstream end of the outer side wall comprises a radially protruding clamping ring and the outer side wall has a cross-section with a swan neck profile.

8. The front panel according to claim 7, wherein the radially protruding clamping ring has a lateral annular radius ($r_1$) and an axial height ($b_1$), wherein the lateral annular radius ranges from 2 millimeters to 25 millimeters and the axial height ranges from 2 millimeters to 25 millimeters.

9. The front panel according to claim 1, wherein the hot-side wall has a first material thickness ($S_1$) and the cold-side wall has a second material thickness ($S_2$), wherein the second material thickness is smaller than the first material thickness, wherein the first material thickness ($S_1$) ranges from 1.5 millimeters to 28 millimeters, wherein the second material thickness ($S_2$) ranges from 20% of the first material thickness ($S_1$) to 80% of the first material thickness ($S_1$).

10. The front panel according to claim 1, wherein the axial spacing between the hot-side wall and the cold-side wall, a first material thickness ($S_1$) of the hot-side wall and a second material thickness ($S_2$) of the cold-side wall, and a protrusion of the outer side wall beyond the cold-side upstream surface of the cold-side wall, are chosen so as to have a total axial height (h) of the front panel of 8 millimeters to 840 millimeters.

11. The front panel according to claim 1, wherein a cavity is defined between the hot-side wall, the cold-side wall, and the outer side wall of the front panel, wherein an axial height ($h_p$) of the cavity ranges from $1.5S_1$ to $(h-(S_1+S_2))$, wherein $S_1$ is a material thickness of the hot-side wall, $S_2$ is a material thickness of the cold-side wall, and h is a total axial height of the front panel.

12. A front panel for a combustor of a gas turbine, the front panel defining a hot side and a cold side and comprising:

at least one aperture adapted for receiving a combustor part;

a hot-side wall defining a hot-side downstream surface of the front panel;

a cold-side wall defining a cold-side upstream surface of the front panel, wherein the hot-side wall and the cold-side wall are axially spaced from one another and extend parallel to one another; and an outer side wall connecting the hot-side wall and the cold-side wall, wherein the hot-side wall has a first material thickness ($S_1$) and the cold-side wall has a second material thickness ($S_2$), wherein the second material thickness is smaller than the first material thickness.

13. The front panel according to claim 1, wherein the outer side wall has at least one first intermediate portion, wherein said at least one first intermediate portion comprises:

a material thickness that is smaller than a material thickness of a second portion of the outer side wall, and/or is laterally shifted with respect to the second portion of the outer side wall.

14. The front panel according to claim 13, wherein the material thickness of the at least one first intermediate portion of the outer side wall is 50% to 80% of the material thickness of the second portion of the outer side wall, and/or wherein a lateral shift of the at least one first intermediate portion of the outer side wall with respect to the second portion of the outer side wall is 30% to 100% of the material thickness of the second portion.

15. A combustor arrangement for a gas turbine comprising:

the front panel according to claim 1.

16. The front panel according to claim 1, wherein the hot-side wall, the outer side wall, and the cold-side wall are made from one piece.

17. The front panel according to claim 1, wherein an upstream end of the outer side wall axially protrudes beyond the cold-side upstream surface of the cold-side wall.

18. A front panel for a combustor of a gas turbine, the front panel defining a hot side and a cold side and comprising:

at least one aperture adapted for receiving a combustor part;

a hot-side wall defining a hot-side downstream surface of the front panel;

a cold-side wall defining a cold-side upstream surface of the front panel, wherein the hot-side wall and the cold-side wall are axially spaced from one another and extend parallel to one another;

an outer side wall connecting the hot-side wall and the cold-side wall; and a radially protruding clamping ring provided on a downstream end of the outer side wall, wherein the radially protruding clamping ring has a lateral annular radius ($r_1$) and an axial height ($b_1$), wherein the lateral annular radius ranges from 2 millimeters to 25 millimeters and the axial height ranges from 2 millimeters to 25 millimeters.

19. The front panel according to claim 12, wherein each aperture of the at least one aperture is defined by a respective annular sleeve, wherein each respective annular sleeve extends from the hot-side wall to the cold-side wall, connects the hot-side wall and the cold-side wall to one another, and provides a seat for a respective combustor part.

* * * * *